US005894315A

United States Patent [19]

Yamane

[11] Patent Number: 5,894,315

[45] Date of Patent: Apr. 13, 1999

[54] PRINTER HAVING CARRIAGE DRIVE CONTROL ARRANGEMENT

[75] Inventor: Toshiyuki Yamane, Chiryu, Japan

[73] Assignee: Brother Kogyo Kabushiki Kaisha, Nagoya, Japan

[21] Appl. No.: 08/739,197

[22] Filed: Oct. 30, 1996

[30] Foreign Application Priority Data

Nov. 9, 1995 [JP] Japan ..... 7-317384

[51] Int. Cl.[6] ..... B41J 29/38; B41J 23/00; B41J 21/16

[52] U.S. Cl. ..... 347/37; 400/279; 347/14

[58] Field of Search ..... 347/37, 14, 19; 400/279, 124.05, 322, 323; 395/105

[56] References Cited

U.S. PATENT DOCUMENTS 4,777,609 10/1988 Cavill et al. ..... 395/105

*Primary Examiner*—N. Le
*Assistant Examiner*—Thinh Nguyen
*Attorney, Agent, or Firm*—Oliff & Berridge, PLC

[57] ABSTRACT

A printer has a carriage drive control arrangement. A first control portion is provided for controlling ink ejection of a print head. A second control portion is provided for controlling a feed motor for driving a platen. A carriage mounts thereon the print head and is provided movably along a paper on the platen. A carriage control circuit is provided for controlling a carriage drive motor. A photosensors are connected to the carriage control circuit. The photosensors produce and transmit pulse signals to the carriage control circuit where moving distance and moving velocity of the carriage are computed based on the pulse signals. A second control portion transmit data of interrupt command output conditions to the carriage control circuit, the conditions being preset moving distance and preset moving velocity. If the computed distance or velocity is coincident with the preset distance or velocity, an interrupt command signal is transmitted from the carriage control circuit to the second control portion. Based on the interrupt command signal, the second control portion will transmit necessary data for changing driving mode of the carriage drive motor by way of the carriage control circuit.

21 Claims, 9 Drawing Sheets

PRINTER HAVING CARRIAGE DRIVE CONTROL ARRANGEMENT

BACKGROUND OF THE INVENTION

The present invention relates to a printer, and more particularly, to the printer provided with a carriage drive control arrangement, the carriage having a print head mounted thereon.

There have been known ink jet printers with a print head formed with a plurality of jet nozzles. The print head is mounted on a carriage reciprocally movable in a print direction while maintained in confrontation with a print sheet. By ejecting ink from nozzles while using a carriage drive motor to drive the carriage in the print direction, an image can be formed out of dot patterns on the print sheet.

If a DC motor is used as the carriage drive motor, a circular encoder disk formed with a plurality of radial slits is attached to the DC motor.

A photosensor for determining timing of dot printing is provided in the printer. The photosensor includes a light emitting element and a light receiving element to transmit and receive light through the slits. The photosensor emits a pulse signal formed from alternating high and low level signals, which correspond to presence and absence of slits, and having a period equal to the sum of successive high and low level signals. The number of high and low level signals outputted from the photosensor is proportional to the distance moved by the carriage. Also, time duration of one period of the pulse signal indicates the speed of the carriage. By calculating these pulse signals, the print position of the carriage and the movement speed of the carriage can be determined so that timing of the dot printings can be determined.

At every rising edge and falling edge timing of the pulse signal, interrupt signal is inputted into a CPU of a control device. The control device computes the moving speed and the moving position of the carriage based on the pulse period and numbers of the pulses of the interrupt signal, so that the carriage drive motor is subjected to feed back control in order to permit the carriage drive motor to provide a predetermined speed mode including acceleration mode, constant velocity mode and deceleration mode. A pulse counter counts the pulse signal transmitted from the photosensor, and the CPU reads the count value.

If the carriage is driven for image recordation on the print sheet, a great number of pulse signals are generated in accordance with the movement of the carriage, and the pulse signals are inputted into the control device at every minute time period as a interrupt command. Therefore, the CPU of the control device receives the interrupt command at every minute time period, while the CPU also executes data processing for image printing. Accordingly, the CPU undergoes excessive load, and as a result, the image print processing may be delayed. In particular, if the carriage is moved at high speed for high speed printing, input pitch of the interrupt command is extremely short. Consequently, a CPU capable of high speed processing is required, which increases cost of the control device.

SUMMARY OF THE INVENTION

It is therefore an object of the present invention to provide a printer having a carriage drive control arrangement in which processing load in a control portion such as CPU can be reduced, and a CPU having low processing capability can be used.

Another object of the present invention is to provide such printer capable of providing optimum driving manner of the carriage in each acceleration mode, constant velocity mode and deceleration mode.

These and other objects of the present invention will be attained by a printer including printing means, a carriage, carriage drive means, control means, pulse signal generation means, and a carriage control circuit. The printing means has a print head for printing an image on an image recording medium. The carriage is movable along the image recording medium and mounts thereon the print head. A point of origin is defined with respect to a movement of the carriage. The carriage drive means is adapted for drivingly moving the carriage. The control means is adapted for controlling the printing means and the carriage drive means. The control means has memory means in which are stored data of interrupt command output conditions having parameters of moving distance of the carriage from the point of origin and moving velocity of the carriage. The pulse signal generation means is adapted for generating pulse signals indicative of moving distance and moving direction of the carriage in accordance with the driving of the carriage drive means. The carriage control circuit is connected to the control means for computing a moving distance of the carriage from the point of origin and for computing moving velocity thereof based on the pulse signals transmitted from the pulse signal generation means. The carriage control circuit is also connected to the control means so that the data of interrupt command output conditions transmitted from the control means can be stored in the carriage control circuit. The carriage control circuit compares the computed moving distance and the computed moving velocity with each parameters of the data of the interrupt command output conditions, and outputs an interrupt command signal to the control means when at least one of the computed moving distance and the computed moving velocity is coincident with at least one of the parameters of the data of the interrupt command output conditions.

Each pulse signal generated in the pulse signal generation means is not directly transmitted to the control means, but is transmitted to the carriage control circuit where moving velocity and moving distance of the carriage is computed. Only when the computed distance or velocity becomes coincident with the data of interrupt command output condition, the interrupt command signal is transmitted into the control means so as to control driving mode of the carriage. Accordingly, the control means is not imposed with large load, and as a result inexpensive processor providing low processing capability can be used as the control means.

DETAILED DESCRIPTION OF THE PREFERRED EMBODIMENTS

A printer having a carriage drive control arrangement according to a preferred embodiment of the present invention will be described while referring to the accompanying drawings. The embodiment is applied to an ink jet printer for recording images by ejecting ink droplets from a print head supplied with ink from a detachably mounted ink cartridge.

Figure 1:
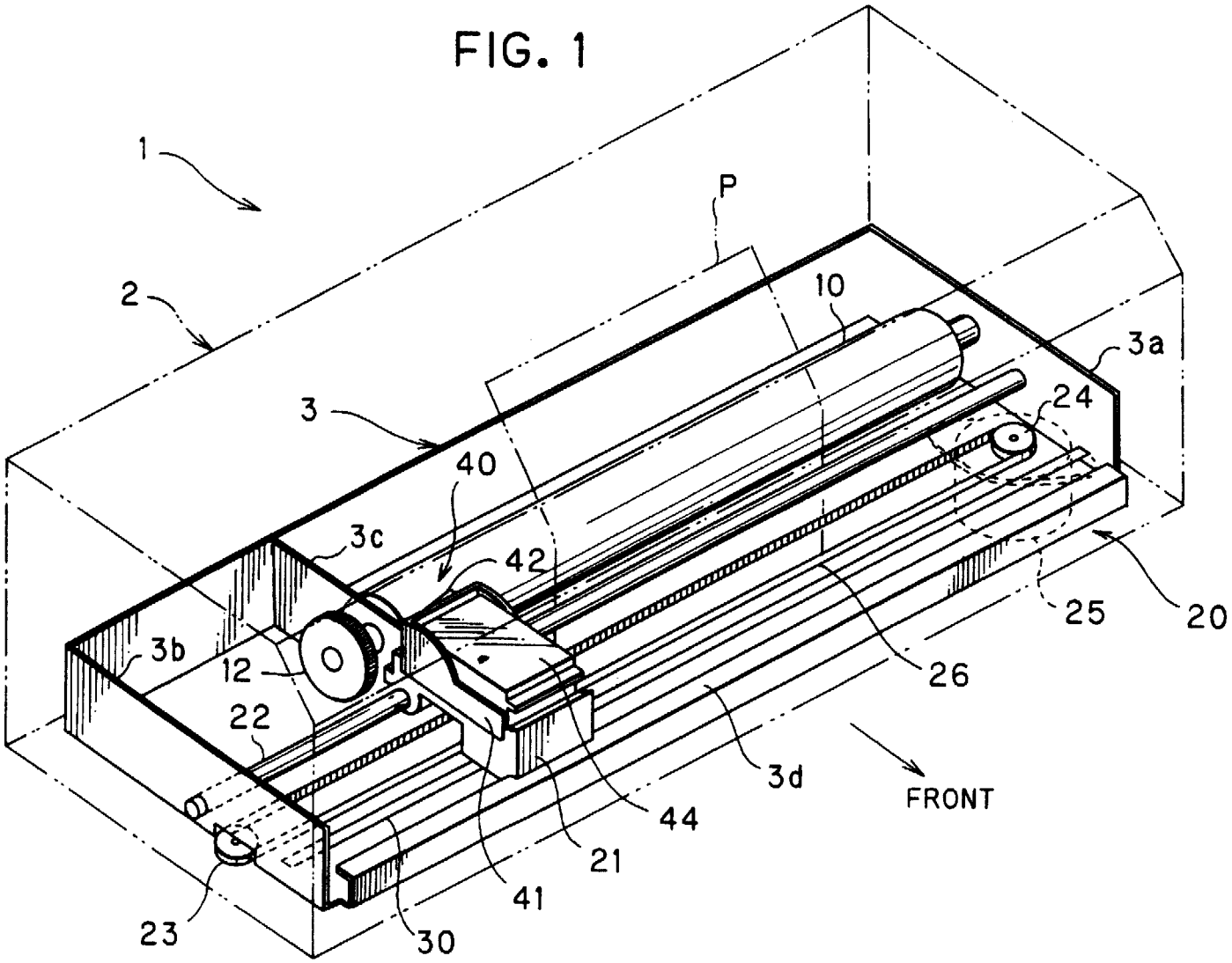
FIG. 1 is a perspective view partially in phantom showing a printer to which a print control system according to one embodiment of the present invention is applied.

As shown in FIG. 1, an ink jet printer 1 includes a frame 3 provided within a cover 2, a platen 10, a carriage drive mechanism 20 for driving a carriage 21, and an ink ejection mechanism 40 for ejecting toward a print sheet P ink contained in an ink cartridge 44.

Figure 2:
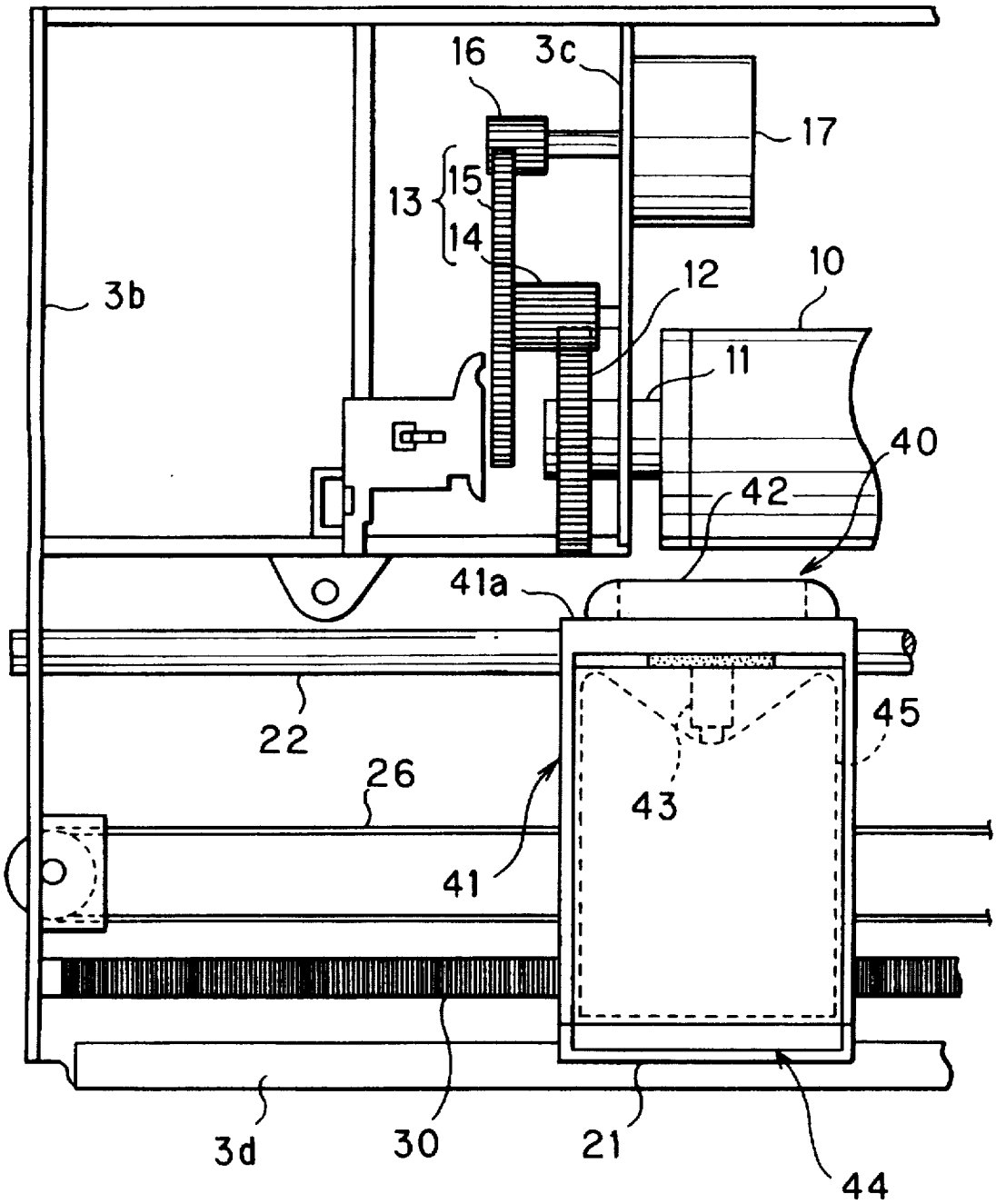
FIG. 2 is a plan view showing a printing mechanism of the printer.

As shown in FIGS. 1 and 2, the frame 3 has right and left side walls 3*a*, 3*c* and a leftmost end wall 3*b*. The platen 10 includes a platen shaft 11 extending leftward and rightward as viewed in FIGS. 1 and 2 and a rubber lining surrounding the platen shaft 11. Distal end portions of the platen shaft 11 are rotatably supported by the side walls 3*a*, 3*c* of the frame 3, respectively. A platen gear 12 is fixedly mounted on the left end of the platen shaft 11. Further, a compound gear 13 is rotatably supported on the side wall 3*c*. The compound gear 13 includes a first slave gear 14 meshingly engaged with the platen gear 12, and a second slave gear 15 provided coaxially with the first slave gear 14.

A feed motor 17 is fixedly secured to the side wall 3*c*. The feed motor 17 has a motor shaft on which a drive gear 16 is fixedly mounted. The drive gear 16 is meshingly engaged with the second slave gear 15. With this configuration, when the feed motor 17 is given to rotate in a predetermined direction, the drive gear 16 rotates in the same direction. This rotates the platen gear 10 via the compound gear 13 and the platen gear 12, so that a print sheet P is fed in a predetermined sheet feed direction.

Next, the carriage drive mechanism 20 will be described with reference to FIGS. 1 and 2. The carriage 21 is disposed in a horizontal posture in front of the platen 10. A guide rod 22 and a guide rail portion 3*d* are supported on the frame 3 in parallel with the platen 10. The carriage 21 is mounted at its rear end portion on the guide rod 22 and at its front end portion on the guide rail portion 3*d* so as to be freely reciprocally movable leftward and rightward.

A driven pulley 23 is rotatably supported on the leftmost wall 3b at the leftmost movable position of the carriage 21. Further, a drive pulley 24 is disposed at the rightmost movable position of the carriage 21. The drive pulley 24 is fixedly mounted on a drive shaft of a carriage drive motor 25, such as a DC motor. An endless timing belt 26 is suspended between the pulleys 23 and 24. The timing belt 26 is attached to the lower end of the carriage 21. With this configuration, when the carriage drive motor 25 is driven to rotate, the carriage 21 is driven by the pulleys 23, 24 and the timing belt 26 while supported on the guide rod 22 and guide rail portion 3*d* to move reciprocally in a one print direction, that is, rightward, and a reverse printing direction, that is, leftward.

Figure 3:
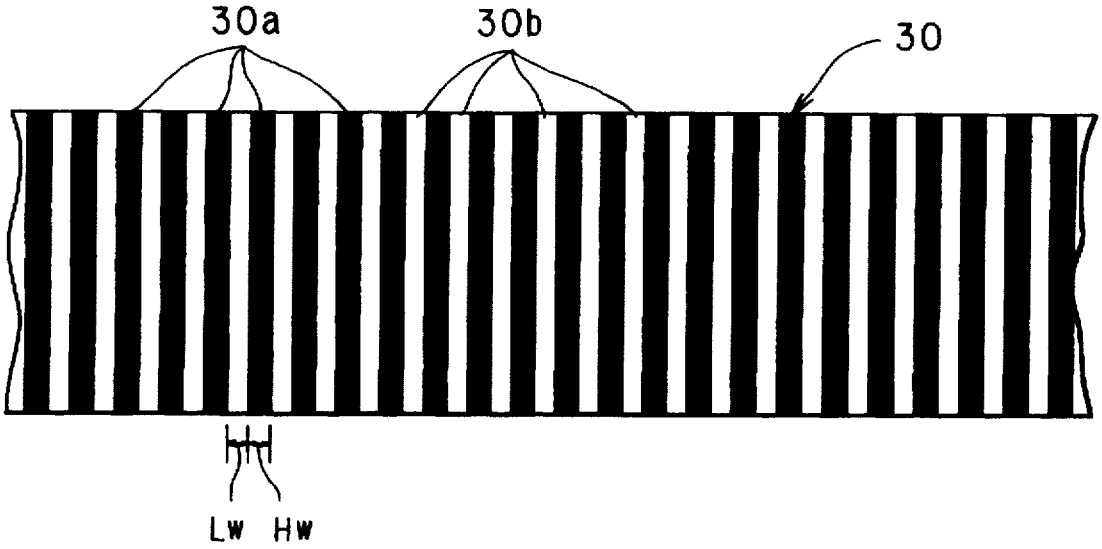
FIG. 3 is an enlarged plan view showing an encoder member of the printer.

A thin-film band-shaped encoder member 30 is provided below the carriage 21 so as to extend in leftward and rightward directions. As best shown in FIG. 3, the encoder member 30 is formed with alternating high level portions 30*a* printed black with a predetermined width Hw and low level portions 30*b* transparent with a predetermined width Lw.

A pair of photosensors 31, 32 (FIG. 4) are fixedly attached to the lower surface of the carriage 21 so as to confront the encoder member 30. The photosensors 31, 32 output pulse signals formed from alternating high level signals in correspondence with the high level portions 30*a* and low level signals in correspondence with the low level portions 30*b*. The alternating high and low levels are defined by alternating rising and falling edges in a number proportional to movement amount of the carriage 21.

The photosensors 31 and 32 generates a first pulse signal P1 and a second pulse signal P2, respectively in proportion with the moving distance of the carriage 21. Because the photosensors 31 and 32 are positioned at different locations, the waveform of the first pulse signal P1 is out of phase with the waveform of the second pulse signal P2 by a predetermined phase. Further, the high level portion 30*a* and the lower level portion 30*b* have width Hw, Lw of 1/180 inches (about 0.14 mm) taking into consideration the ink ejection timing control with using the first and second pulse signals P1 and P2 for controlling ink ejection from a print head 42 (described later).

Next, the ink ejection mechanism 40 for ejecting ink onto a print sheet P will be described while referring to FIGS. 1 and 2. A box-shaped head holder 41 is mounted on the carriage 21. The head holder 41 has an upstanding wall portion 41*a* including a rear wall and side walls. Thus, the head holder 41 has an upper opening and a front opening. The print head 42 is provided to the wall portion 41*a*. A plurality of nozzles are formed in the ink ejection print head 42. A connection tube 43 extends through the upstanding wall portion 41*a* and is integrally connected with the print head 42.

An ink cartridge 44 housing an ink impregnating member 45 is detachably mounted on the head holder 41. The connection tube 43 passes through an ink supply port (not shown in the drawings) formed in the ink cartridge 44 so that its tip contacts the ink impregnating member 45. With this arrangement, ink from the ink cartridge 44 is supplied through the connection tube 43 to the print head 42. The ink is ejected from the nozzles of the print head 42 and printed on a recording sheet P during movement of the carriage 21 at its constant moving velocity.

Figure 4:
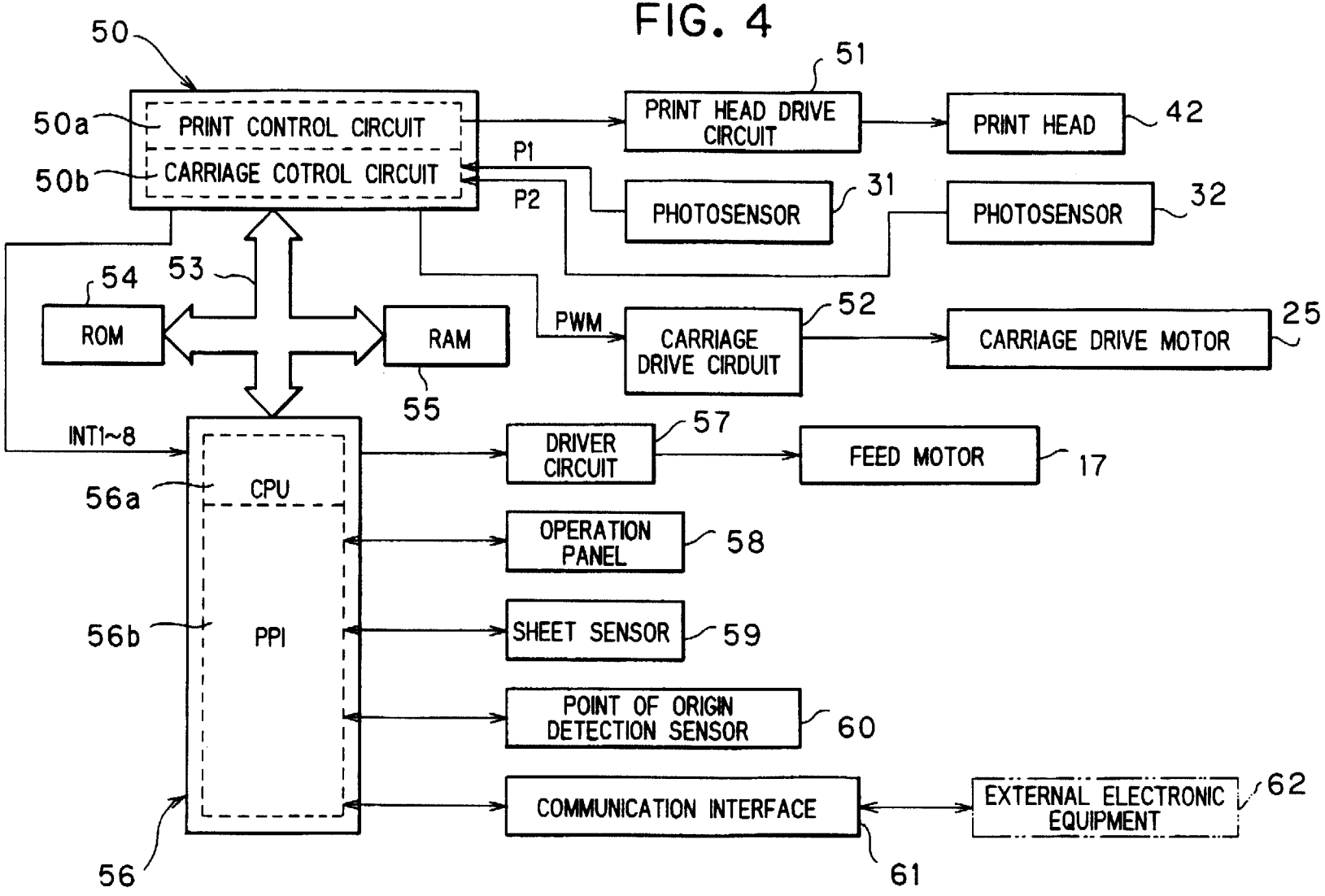
FIG. 4 is a block diagram showing components of a print control system according to a first embodiment of the present invention and their electrical connection to other components of the printer.

Next, a control system of the ink jet printer 1 will be described with reference to the block diagram shown in FIG. 4. A first control portion 50 includes a print control circuit 50*a* and a carriage control circuit 50*b*. These circuits 50*a* and 50*b* are respectively provided by an application specific integrated circuit (ASIC) constituted by a hard logic circuit. The print control circuit 50*a* is connected to a head drive circuit 51 which is connected to the print head 42. The print control circuit 50*a* is adapted for outputting an ejection drive signal to the head drive circuit 51 for performing ink ejection from the ink ejection nozzles of the print head 42. The carriage control circuit 50*b* is connected to the photosensors 31 and 32 and is also connected to a carriage drive circuit 52 which is connected to the carriage drive motor 25. The carriage control circuit 50*b* is adapted for receiving pulse detection signals P1, P2 from the photosensors 31, 32 and for outputting pulse width modulation drive signal PWM to the carriage drive circuit 52 so as to drive the carriage drive motor 25.

The carriage control circuit 50b is also adapted to compute moving velocity of the carriage 21 by way of pulse period based on the first and second pulse signals P1 and P2 transmitted from the photosensors 31, 32. Further, the carriage control circuit 50b is also adapted to judge moving direction of the carriage 21 and compute moving distance of the carriage 21 from a point of origin by incrementing or decrementing pulse count value based on the rising or falling of the first pulse signal P1 at the low level period of the second pulse signal P2. The carriage control circuit 50b provides a plurality of registers for storing data of interrupt command output condition, etc. supplied from a second control portion 56 described later so as to compare the data of the interrupt command output condition with the data of the moving distance and moving velocity of the carriage 21 those data being obtained each time the first and second pulse signals P1 and P2 are received in the carriage control circuit 50b. If at least one of the computed moving velocity and the moving distance obtained in the carriage control circuit 50b becomes coincident with the data of interrupt command output condition, the carriage control circuit 50b is adapted to transmit an interrupt command signal to the second control portion 56 described later.

The first control portion 50 is connected to the second control portion 56 through a data bus 53 to which a ROM 54 and a RAM 55 are connected. The ROM 54 has a plurality of memory regions independent of each other for storing various data of interrupt command output conditions, such as first data of interrupt command output condition concerning accelerating region of the carriage 21 starting from stopping state of the carriage 21, second data of interrupt command output condition concerning constant velocity region of the carriage 21 after the acceleration, and third data of interrupt command output condition concerning decelerating region of the carriage 21 after the constant velocity region and ending at the stop of the carriage 21. As described later, since the data of interrupt command output conditions are provided different from each other among the accelerating region, constant velocity region and the decelerating region, the carriage 21 can be driven at is optimum driving condition in each region.

The ROM 54 also stores therein data of duty ratio for controlling pulse width of the PWM signal serving as the drive signal for driving the carriage in the acceleration mode, constant velocity mode and the deceleration mode. The ROM 54 further stores therein a print control program. On the other hand, RAM 54 has a image data memory for storing therein the inputted image data, various memories necessary for image recordation, and a buffer.

The second control portion 56 includes a single chip CPU 56a and a peripheral input/output interface 56b such as a programmable peripheral interface PPI so as to execute image processing based on the input image data and to control the neighboring circuits. To the peripheral input/output interface 56b, are connected a driver circuit 57 for driving the feed motor 17, an operation panel 58 having a power switch, various switches and a display lamp, a sheet sensor 59 for detecting the existence of the recording paper P and leading edge position thereof, and a point of origin detection sensor 60 for detecting the point of origin of the carriage 21. Further, a communication interface 61 is also connected to the peripheral input/output interface 56b. The communication interface 61 is connected to an external electronic equipment 62 such as a host computer which transmits image data to the communication interface 61.

If the driving mode of the carriage 21 is to be changed from its stop mode to the acceleration mode, the second control portion 56 outputs a duty ratio data for the acceleration region, for example duty ratio data amounting about 80%, to the carriage control circuit 50b. Accordingly, the carriage control circuit 50b produces drive signal PWM in accordance with the duty ratio data, and the drive signal PWM is transmitted to the carriage drive circuit 52. If the driving mode of the carriage 21 is to be changed from its acceleration mode to the constant velocity mode, the second control portion 56 outputs a duty ratio data for the constant velocity region, for example duty ratio data amounting about 50%, to the carriage control circuit 50b. Accordingly, the carriage control circuit 50b produces drive signal PWM in accordance with the duty ratio data, and the drive signal PWM is transmitted to the carriage drive circuit 52.

Figure 5:
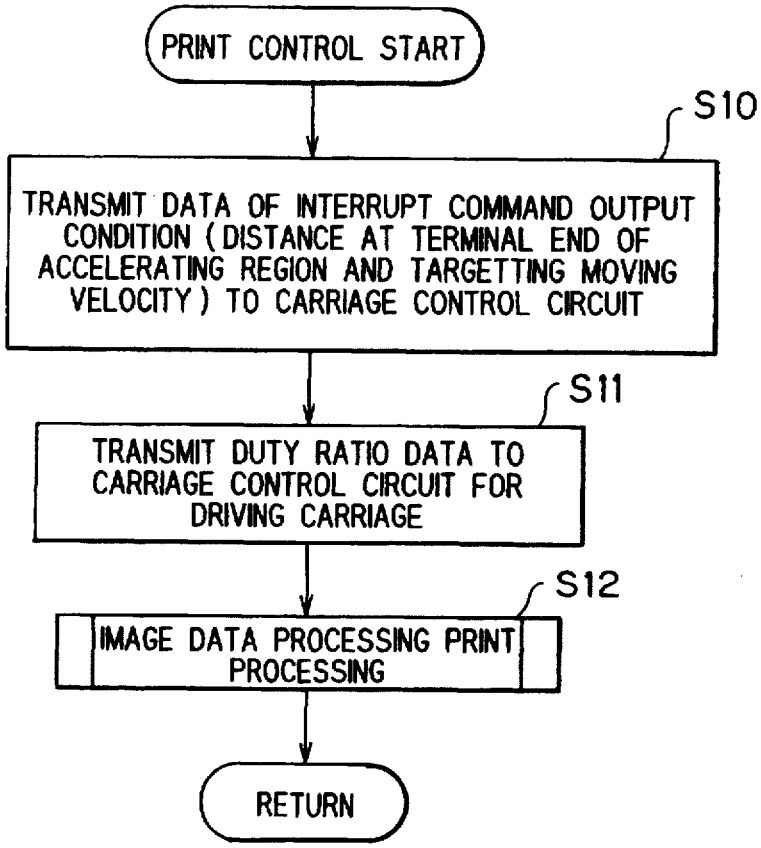
FIG. 5 is a flowchart showing a print control routine executed in the first embodiment.

A print control routine executed in the second control portion 56 will be described with reference to a flowchart shown in FIG. 5. If the image data are transmitted from the external electronic equipment 62 for starting image printing, print control routine is started. Prior to the start of the driving of the carriage 21, in step S10, the second control portion 56 outputs first group data of interrupt command condition to the carriage control circuit 50b. The first group data are constituted by a moving distance at the terminal end of the accelerating region and targeting moving velocity, those being data for the accelerating region. These condition data are stored at the predetermined registers of the carriage control circuit 50b. Since there are two parameters in the first group data, i.e., the moving distance and the targeting moving velocity, carriage driving control in the accelerating region can be precisely performed.

Then, in step S11, duty ratio data are transmitted from the second control portion 56 to the carriage control circuit 50b for starting driving of the carriage 21. Therefore, the carriage drive motor 25 is acceleratingly driven in accordance with the drive signal PWM in accordance with the duty ratio data. Then image data processing and print processing through the ink ejection control are executed in step S12. When the print processing is terminated, the print control is ended and the routine goes back to a main routine. During execution of the image data processing and print processing, the interrupt command signals are repeatedly inputted into the second control portion 56 from the carriage control circuit 50b in accordance with the movement of the carriage 21.

Figure 6:
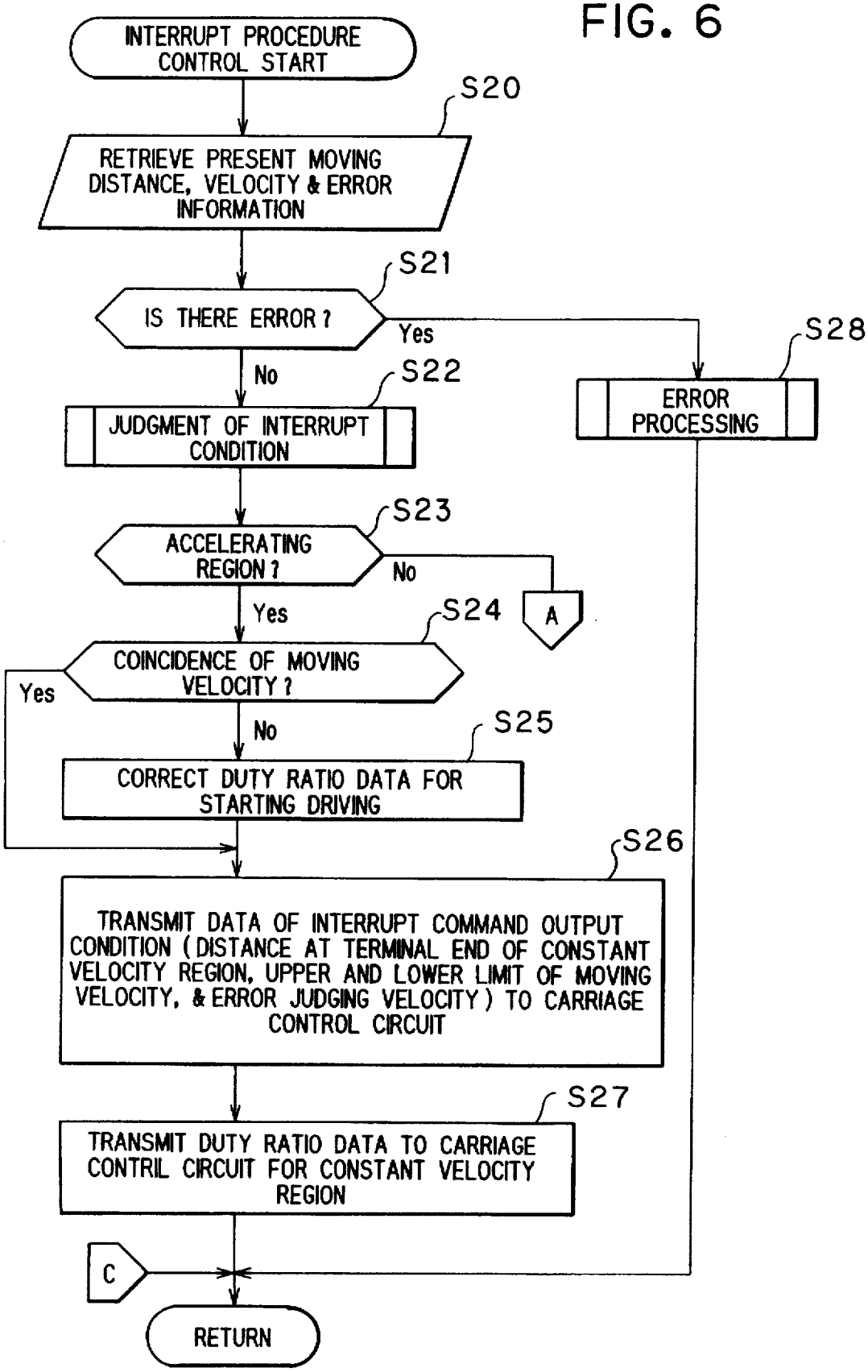
FIG. 6 is a flowchart showing a part of an interrupt handling control routine executed in the first embodiment.
Figure 7:
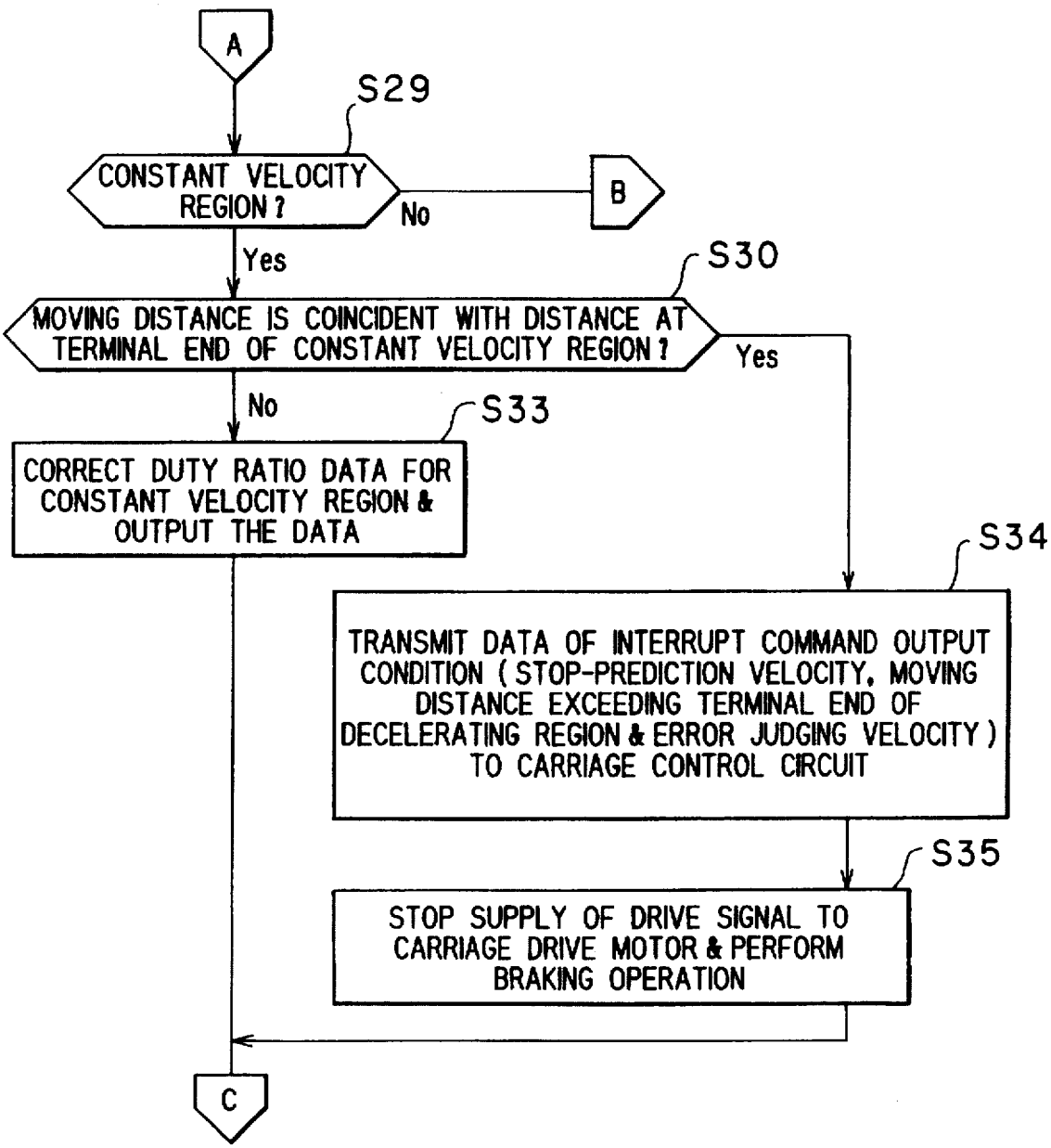
FIG. 7 is a flowchart showing another part of the interrupt handling control routine.

Interrupt procedure control routine will be executed upon inputting the interrupt command signal into the second control portion 56. This routine will be described with reference to FIGS. 6 through 8. In the above described step S10, the second control portion 56 transmits, to the carriage control circuit 50b, a pulse count value CTA shown in FIG. 9 to be counted in the carriage control circuit 50b, the pulse count value CTA corresponding to the moving distance of the carriage at the terminal end of the accelerating region. Further, the second control portion 56 also transmits, to the carriage control circuit 50b, a targeting moving velocity of the carriage at the terminal end of the accelerating region, i.e., upper limit velocity at the constant velocity region as shown in FIG. 10. Moreover, the duty ratio data, for example about 80%, for driving the carriage drive motor at the timing TO (FIG. 9) is transmitted to the carriage control circuit 50b. As a result, carriage driving operation is started, and moving velocity of the carriage is gradually increased in the accelerating region and moving distance of the carriage from the point of origin is increased.

In the accelerating region, if at least one of the carriage moving distance and the carriage moving velocity those obtained by the first and second pulse signals P1 and P2 becomes coincident with the moving distance at the terminal end of the accelerating region and the upper limit of the moving velocity those being inputted from the second control portion 56 to the carriage control circuit **50*b*, the interrupt command signal is transmitted from the carriage control circuit 50*b* to the second control portion 56**, whereupon interrupt procedure control will be started.

First, present moving distance of the carriage 21 and moving velocity thereof those being computed in the carriage control circuit **50*b* and error information are retrieved in step S20. If there is no error (S21:No), judgment of interrupt condition will be executed in S22** so as to make judgment as to which one of the interrupt command output condition, i.e., which one of the moving distance or moving velocity is coincident with the computed moving distance or moving velocity.

For example, if the acceleration of the carriage 21 is still continuing (S23: Yes) in view of the data of the present moving distance of the carriage, or with reference to a flag preset, the judgment falls that the interrupt command signal is produced not by the coincidence of the moving velocity but by the coincidence of the moving distance (S24: No). This interrupt command signal is delineated by INT1 in FIG. 9. This implies that the present moving velocity of the carriage 21 is lower than the targeting moving velocity thereof. Thus, correction is performed in S25 so that the duty ratio data for starting driving of the carriage drive motor is slightly increased in order to increase acceleration of the carriage 21 in a subsequent acceleration mode of the carriage 21.

Then, in order to drive the carriage 21 at the constant velocity, the second group data of interrupt command output condition for the constant velocity region are inputted from the second control portion 56 to the carriage control circuit **50*b* in step S26. The second group data of interrupt command output condition for the constant velocity mode are constituted by the moving distance of the carriage at the terminal end of the constant velocity region, upper limit and lower limit of the moving velocity, and error judgment velocity. Further, a duty ratio data for the constant velocity region are transmitted from the second control portion 56 to the carriage control circuit 50*b* in S27. Then, the routine goes back to the step S12 in FIG. 5** to execute the image data processing and print processing.

Figure 9:
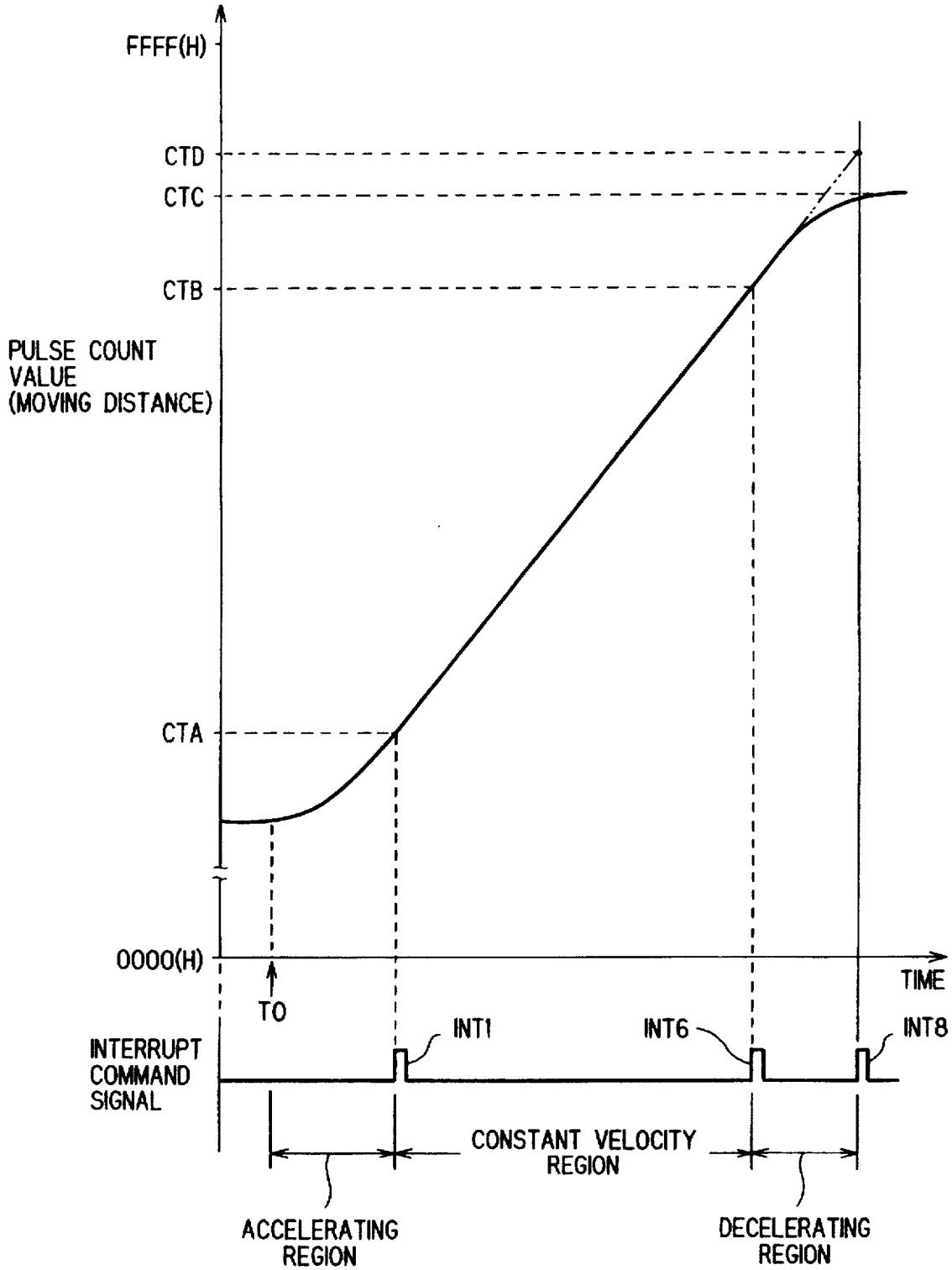
FIG. 9 is a graph showing the relationship between the moving position of a carriage and the pulse count value according to the embodiment.
Figure 10:
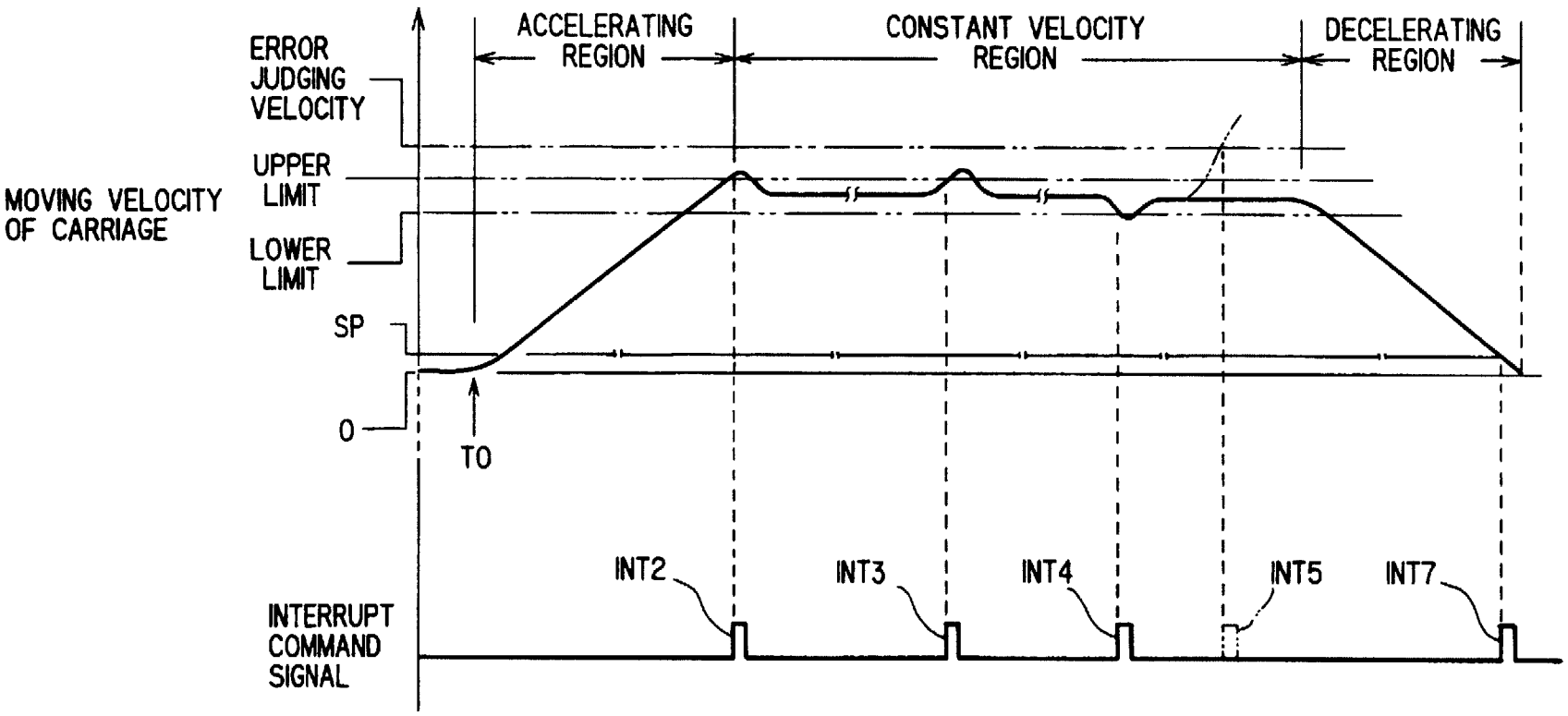
FIG. 10 is a graph showing the relationship between the moving position of the carriage and the moving velocity thereof according to the embodiment.

In the above described step S26, the second control portion 56 transmits, to the carriage control circuit **50*b*, a pulse count value CTB shown in FIG. 9 to be counted in the carriage control circuit 50*b*, the pulse count value CTB corresponding to the moving distance of the carriage at the terminal end of the constant velocity region. Further, the second control portion 56 also transmits, to the carriage control circuit 50*b*, an upper limit and lower limit of the moving velocity of the carriage in the constant velocity region as shown in FIG. 10. Furthermore, the error judging velocity is also output from the second control portion 56 to the carriage control circuit 50*b***.

On the other hand, in the step S24, if the interrupt command signal is generated as shown by INT2 in FIG. 10 because of the coincidence of the moving velocity computed in the carriage control circuit **50*b* with the data of the interrupt command output condition with respect to the moving velocity transmitted from the second control portion 56 before the computed moving distance becomes coincident with the transmitted data of the moving distance, the judgment in step S24 falls Yes. Then, the routine proceeds into step S26 and S27 without execution of the step S25**, and goes back to the main routine. Accordingly, the accelerating mode can be shifted to the constant velocity mode.

In the constant velocity mode, when the interrupt command signal is inputted through the steps of S20, S21:No, S22, S23:No, and S29:Yes, the routine goes into step S30 to make judgment as to whether or not the carriage moving distance computed in the carriage control circuit **50*b* is coincident with the data of the interrupt command output condition concerning the moving distance at the terminal end of the constant velocity region. If the judgment in the step S30 falls No, it can be concluded that the interrupt command signal is inputted because the carriage moving velocity computed in the carriage control circuit 50*b* is coincident with or exceeds the data of the upper or lower limit velocity, which is the other data of interrupt command output condition. Accordingly, moving velocity of the carriage 21 in the constant velocity region must be changed to a predetermined constant moving velocity between the upper and lower limits. To this effect, duty ratio data for the constant velocity mode is corrected, and the corrected duty data ratio is outputted to the carriage control circuit 50*b* in S33**. Then, the routine goes back to the main routine.

For example, as shown in FIG. 10, if the interrupt command signal INT3 is inputted because the computed moving velocity of the carriage 21 exceeds the upper limit velocity, the duty ratio data are corrected to be smaller, so that the moving velocity of the carriage is changed to an intermediate velocity between the upper limit and the lower limit. On the other hand, if the interrupt command signal INT4 is inputted because the computed moving velocity of the carriage 21 is lower than the lower limit velocity, the duty ratio data are corrected to be greater, so that the constant moving velocity of the carriage can be increased. Accordingly optimum constant velocity can be provided for the subsequent constant velocity mode.

Further, if the interrupt command signal INT5 (FIG. 10) is inputted because the computed moving velocity of the carriage 21 largely exceeds the error judging velocity so that the velocity control is disabled, error information stored in the carriage control circuit **50*b* is retrieved through the steps S20, and S21: Yes, error processing is executed in S28**, and the routine goes back to the main routine. Accordingly overrun of the carriage can be promptly detected and avoided.

On the other hand, in the constant velocity mode, when the interrupt command signal INT6 (FIG. 9) is inputted because the computed moving distance of the carriage 21 is coincident with the interrupt command output condition with respect to the moving distance at the terminal end of the constant velocity region through the steps of S20, S21:No, S22, S23:No, S29:Yes, and S30:Yes, the third group data of interrupt command output conditions for the deceleration mode are outputted from the second control portion 56 to the carriage control circuit **50*b* in S34 so as to stop the carriage. The third group data of interrupt command output conditions are constituted by (a) a stop-predictable moving velocity at which the carriage is about to be stopped, i.e., an extremely low velocity at which the carriage is deemed to be stopped (see line SP in FIG. 10), (b) moving distance CTD exceeding the terminal end of the decelerating region (see FIG. 9**, where pulse count value CTC corresponds to the terminal end position of the decelerating region, and the pulse count value CTD exceeds the CTC, and (c) error judging velocity.

Then, the routine proceeds into S35 in which output of drive command signal from the second control portion 56 to the carriage control circuit **50*b* for producing the drive signal therein for driving the carriage drive motor 25** is stopped, and braking operation is performed. Then, the routine goes back to the main routine.

Figure 8:
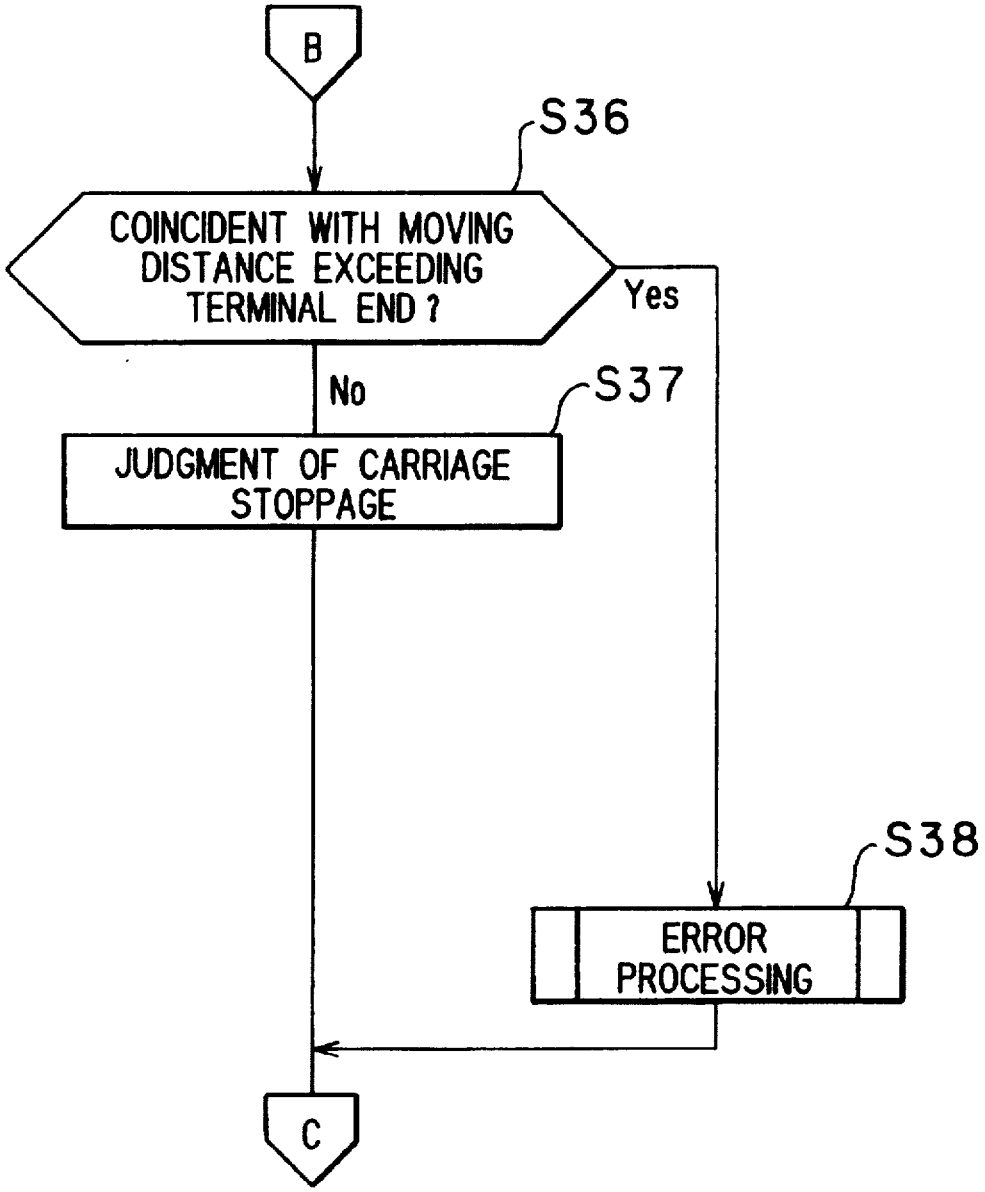
FIG. 8 is a flowchart showing a remaining part of the interrupt handling control routine.

In the decelerating mode, as shown in FIG. 8, if the interrupt command signal INT8 (FIG. 9) is inputted not because the moving velocity of the carriage is decelerated to the stop-prediction velocity, but because the moving distance of the carriage becomes coincident with the CTD, the judgment in a step S36 falls Yes. This means that malfunction occurs. Therefore, error processing is executed in S38 in which movement of the carriage 21 is forcibly stopped by reversely rotating the carriage drive motor 25. Then, the routine goes back to the main routine.

On the other hand, if the interrupt command signal INT7 (FIG. 10) is inputted not because the moving distance of the carriage becomes coincident with the CTD, but because the moving velocity of the carriage is decelerated to the stop-prediction velocity, the judgment in a step S36 falls No. That is, period of the pulse signals P1 and P2 are excessively long and the carriage 21 is decelerated to the stop-prediction velocity before the carriage reaches the moving distance corresponding to the count value CTD. This implies that the carriage 21 is to be stopped correctly at or nearby the terminal end of the decelerating region. Therefore, in S37, determination is made that the carriage is stopped without acknowledgment of complete stoppage of the carriage 21. Then, the carriage control routine is terminated, and the routine goes back to the main routine. Since there are plurality of parameters in the third group data of interrupt command output condition, such as the stop-prediction velocity and the moving distance exceeding the terminal end of the decelerating region, stoppage of the carriage can be promptly detected, and overrun of the carriage can be detected promptly.

Incidentally, in the deceleration control, if the carriage 21 is driven at high speed to have the error judging velocity (not shown in FIG. 10) by any malfunction, the interrupt command signal is also inputted from the carriage control circuit **50*b* to the second control portion due to the malfunction (S20, S21:Yes). Then, error processing is also executed in S28 in which the carriage drive motor 25 is driven to be reversely rotated so as to forcibly stop the carriage 21**. Then, the routine goes back to the main routine.

In the above described embodiment, as described above, the first control portion 50 having the carriage control circuit **50*b* is provided separately from the second control portion 56. The carriage control circuit 50*b* receives pulse signals P1, P2 from the two photosensors 31, 32 in accordance with the driving operation of the carriage drive circuit 52, and the carriage control circuit 50*b* outputs the interrupt command signal to the second control portion 56 when the carriage moving distance or carriage moving velocity computed in the carriage control circuit 50*b* becomes coincident with the data of interrupt command output condition. After starting the driving of the carriage, the second control portion 56 outputs the first group data of interrupt command output conditions for the accelerating region. When the interrupt command signal is received in the second control portion 56 with respect to the termination of the acceleration mode, the second control portion 56 outputs the second group data of interrupt command output condition for the constant velocity region. When the interrupt command signal is received in the second control portion 56 with respect to the termination of the constant velocity mode, the second control portion 56 outputs the third group data of interrupt command output condition for the decelerating region. When the interrupt command signal is received in the second control portion with respect to the termination of the deceleration mode, driving control to the carriage is terminated. Thus, the carriage 21 can be driven at its optimum driving mode in the respective acceleration mode, constant velocity mode, and deceleration mode. In the above control, each pulse signals P1 and P2 are not inputted into the second control portion 56, but only the interrupt command signals are inputted into the second control portion 56 when the pulse data meet with the interrupt command output condition. Consequently, the second control portion 56 is not subjected to high load for processing various data. Accordingly, a low class processor or inexpensive CPU can be used as the CPU 56*a* for the second control portion 56**.

Further, in the constant velocity region, if the interrupt command signal is inputted when the moving velocity of the carriage exceeds the upper limit or become lower than the lower limit which is parameters of the interrupt command output condition, or if the interrupt command signals are inputted at every minute time intervals, the moving velocity of the carriage can be changed to an intermediate velocity between the upper and lower limits. Accordingly, stabilized constant velocity of the carriage can be provided in the constant velocity region. Furthermore, if the moving velocity of the carriage largely exceeds the lower limit or extremely lower than the lower limit so that the velocity control is disabled, interrupt command signal is inputted as a result of the malfunction. Accordingly reckless driving or overrun of the carriage can be detected at early stage by the second control portion 56.

While the invention has been described in detail and with reference to the specific embodiment thereof, it would be apparent to those skilled in the art that various changes and modifications may be made therein without departing from the spirit and scope of the invention.

For example, it is possible to output data concerning a content or parameter of the interrupt from the carriage control circuit **50*a* to the second control portion 56 when the interrupt command signal is outputted from the carriage control circuit 50*a* to the second control portion 56. With this arrangement, in the second control portion 56**, it is unnecessary to judge the content of the interrupt, i.e., it is unnecessary to judge either the velocity or the distance which cause the interrupt command signal. For example, the step S24 can be dispensed with.

Further, each parameter in one of the first through third group data of interrupt command output conditions can be altered dependent on the moving load of the carriage 21 or ambient temperature or circumstance of the printer, and the altered data can be stored and selectively retrieved respectively. Furthermore, instead of the band shaped encoder member 30, a circular disc encoder can be attached to the carriage drive motor 25. Furthermore, the carriage drive control arrangement can be applied to a color ink jet printer and other printing device providing dot patterns.

Further, in the depicted embodiment, the velocity control is performed in the constant velocity region so that the carriage can be moved at a constant velocity. To this effect, the interrupt command signal is generated when the moving velocity of the carriage exceeds the predetermined upper limit or become lower than the predetermined lower limit. In response to the interrupt command signal, duty ratio is corrected for correcting PWM drive signal. However, instead of such a control, it is possible to generate an interrupt command signal each time the carriage reaches a predetermined position, each position being provided by equally dividing a distance bridging between the leading end and terminal end of the constant velocity region. Incidentally, the interrupt command signal is not generated when the carriage reaches the terminal end of the constant velocity region. A distance between neighboring points may be from 20 mm to 40 mm, which is capable of performing duty ratio control yet providing the constant velocity of the carriage. With this control fashion, drive control for providing a constant velocity can be made at every predetermined intervals. In this case, prior to the step S33 in FIG. 7, a step is added so as to determine whether or not the moving velocity of the carriage is within an allowable velocity. If the determination falls No, the routine proceeds the step S33 to correct the duty ratio data for the constant velocity driving. Therefore, velocity control can be performed with respect to each section bridging between neighboring points. If the determination falls Yes, correction is unnecessary, and the step S33 is skipped, and the routine goes back to the main routine.

What is claimed is:

1. A printer comprising:

printing means having a print head for printing an image on an image recording medium;

a carriage movable along the image recording medium and mounting thereon the print head, a point of origin being defined with respect to a movement of the carriage;

carriage drive means for drivingly moving the carriage;

control means for controlling the printing means and the carriage drive means, the control means having memory means in which data of interrupt command output conditions are stored, the data having parameters of moving distance of the carriage from the point of origin and parameters of moving velocity of the carriage;

pulse signal generation means for generating pulse signals indicative of moving distance and moving direction of the carriage in accordance with the driving of the carriage drive means; and a carriage control circuit, connected to the control means, for storing data, and for computing the moving distance of the carriage from the point of origin and for computing the moving velocity thereof based on the pulse signals transmitted from the pulse signal generation means, the carriage control circuit being also connected to the control means so that the data of interrupt command output conditions transmitted from the control means are stored in the carriage control circuit, the carriage control circuit comparing the computed moving distance and the computed moving velocity with each of the parameters of the data of the interrupt command output conditions, and outputting an interrupt command signal to the control means when at least one of the computed moving distance and the computed moving velocity is coincident with at least one of the parameters of the data of the interrupt command output conditions.

2. The printer as claimed in claim 1, wherein the interrupt command signal comprises a signal for interrupting control to the printing means and for making priority of control to the carriage drive means in the control means.

3. The printer as claimed in claim 2, wherein the carriage control circuit also transmit data of the moving distance and the moving velocity to the control means when the interrupt command signal is transmitted from the carriage control circuit to the control means.

4. The printer as claimed in claim 3, wherein the carriage control circuit comprises a hard logic circuit.

5. The printer as claimed in claim 4, wherein the carriage drive means drives the carriage in an accelerating mode in which the carriage is moved in an accelerating region where the carriage starts from a stop position and is then gradually accelerated, a constant velocity mode in which the carriage is moved in a constant velocity region where the carriage is moved at a constant velocity after the acceleration of the carriage, and a decelerating mode in which the carriage is moved in a decelerating region where the carriage is decelerated after the constant velocity region and is then stopped.

6. The printer as claimed in claim 5, wherein the memory means of the control means has a plurality of storage regions independent of each other;

and wherein the data of interrupt command output conditions comprises first group data for use in the accelerating region, second group data for use in the constant velocity region, and the third group data for use in the decelerating region, the first through third group data being stored independently of each other in the independent storage regions.

7. The printer as claimed in claim 6, wherein the carriage control circuit transmits one of a plurality of kinds of driving signals to the carriage drive means so as to selectively provide the accelerating mode, the constant velocity mode, and the deceleration mode;

and wherein the memory means of the control means also stores a plurality of duty ratio data for controlling the driving signals, the plurality of duty ratio data comprising data for the accelerating mode, data for the constant velocity mode and data for the decelerating mode.

8. The printer as claimed in claim 7, wherein the first group data comprises moving distance of the carriage from the point of origin at a terminal end of the accelerating region, and a targeting moving velocity of the carriage.

9. The printer as claimed in claim 8, wherein the control means transmits a selected one of the duty data ratio for the constant velocity mode to the carriage control circuit when an interrupt command signal is transmitted from the carriage control circuit to the control means in the accelerating region.

10. The printer as claimed in claim 8, wherein the control means comprises means for judging coincidence of the computed moving velocity of the carriage with the targeting moving velocity of the first group data when an interrupt command signal is transmitted from the carriage control circuit to the control means in the accelerating region.

11. The printer as claimed in claim 10, wherein the control means further comprises means for correcting the duty ratio data for the accelerating mode if the judging means makes judgment that the interrupt command signal was transmitted because of the coincidence of the computed moving distance of the carriage with the moving distance of the first group data before the computed moving velocity becomes coincident with the targeting velocity of the first group data.

12. The printer as claimed in claim 7, wherein the second group data comprises moving distance of the carriage from the point of origin at a terminal end of the constant velocity region, and upper and lower limit moving velocities of the carriage in the constant velocity region.

13. The printer as claimed in claim 12, wherein the control means comprises means for judging coincidence of the computed moving distance of the carriage with the moving distance of the second group data when an interrupt command signal is transmitted from the carriage control circuit to the control means in the constant velocity region.

14. The printer as claimed in claim 13, wherein the control means further comprises means for correcting the duty ratio data for the constant velocity mode to an intermediate velocity between the upper and lower limits of the second group data based on the data of the moving velocity of the carriage if the judging means makes judgment that the interrupt command signal was transmitted because of the coincidence of the computed moving velocity of the carriage with one of the upper and lower limits of the second group data before the computed moving distance becomes coincident with the moving distance of the second group data.

15. The printer as claimed in claim 14, wherein the second group data further comprises error judging velocity higher than the upper limit or lower than the lower limit.

and wherein the control means further comprises error judging means for judging whether or not the computed moving velocity of the carriage reaches the error judging velocity in the constant velocity region so as to stop the carriage if the judgment in the error judging means falls Yes.

16. The printer as claimed in claim 7, wherein the third group data comprises a carriage stop-prediction velocity at which the carriage is about to be stopped, and carriage moving distance exceeding a terminal end of the decelerating region.

17. The printer as claimed in claim 16, wherein the control means comprises means for judging whether or not coincidence of the computed moving distance with the carriage moving distance of the third group data is earlier than coincidence of the computed moving velocity of the carriage with the carriage stop-prediction velocity of the third group data; and means for performing error processing if the judging means judges that the interrupt command signal was transmitted because of the coincidence of the computed moving distance with the carriage moving distance of the third group data.

18. The printer as claimed in claim 17, wherein the third group data further comprises an error judging velocity;

and wherein the control means further comprises error judging means for judging whether or not the computed moving velocity of the carriage reaches the error judging velocity in the decelerating region so as to stop the carriage if the judgment in the error judging means falls Yes.

19. The printer as claimed in claim 7 wherein the second group data comprises respective moving positions of the carriage, the respective moving positions being provided by equally dividing a distance between a leading end and terminal end of the constant velocity region, and upper and lower limits of the carriage velocity.

20. The printer as claimed in claim 19, wherein the control means comprises means for correcting the duty ratio data for the constant velocity mode to an intermediate velocity between the upper and lower limits of the second group data based on the data of the moving velocity of the carriage at respective moving positions.

21. A printer, comprising:

printing means having a print head for printing an image on an image recording medium;

a carriage movable along the image recording medium and mounting thereon the print head, a point of origin being defined with respect to a movement of the carriage;

carriage drive means for drivingly moving the carriage, the carriage drive means driving the carriage in an accelerating mode in which the carriage is moved in an accelerating region where the carriage starts from a stop position and is then gradually accelerated, a constant velocity mode in which the carriage is moved in a constant velocity region where the carriage is moved at a constant velocity after the acceleration of the carriage, and a decelerating mode in which the carriage is moved in a decelerating region where the carriage is decelerated after the constant velocity region and is then stopped;

control means for controlling the printing means and the carriage drive means, the control means having memory means in which data of interrupt command output conditions are stored, the data having parameters of moving distance of the carriage from the point of origin and parameters of moving velocity of the carriage, the memory means having a plurality of storage regions independent of each other, the data of interrupt command output conditions including first group data for use in the accelerating region, second group data for use in the constant velocity region, and third group data for use in the decelerating region, the first through third group data being stored independently of each other in the independent storage regions;

pulse signal generation means for generating pulse signals indicative of moving distance and moving direction of the carriage in accordance with the driving of the carriage drive means; and a carriage control circuit, connected to the control means, for storing data, and for computing the moving distance of the carriage from the point of origin and for computing the moving velocity thereof based on the pulse signals transmitted from the pulse signal generation means, the carriage control circuit being also connected to the control means so that the data of the interrupt command output conditions transmitted from the control means are stored in the carriage control circuit, the carriage control circuit comparing the computed moving distance and the computed moving velocity with each parameters of the data of the interrupt command output conditions, and outputting an interrupt command signal to the control means when at least one of the computed moving distance and the computed moving velocity is coincident with at least one of the parameters of the data of the interrupt command output conditions.

* * * * *